United States Patent [19]
Maier et al.
[11] 4,125,072
[45] Nov. 14, 1978

[54] WORKPIECE TURNING DEVICE

[75] Inventors: Karl Maier, Kuchen; Herbert Höhn, Uhingen, both of Fed. Rep. of Germany

[73] Assignee: L. Schuler GmbH, Fed. Rep. of Germany

[21] Appl. No.: 729,175

[22] Filed: Oct. 4, 1976

[30] Foreign Application Priority Data

Oct. 3, 1975 [DE] Fed. Rep. of Germany ..... 2544203

[51] Int. Cl.² ..... B30B 15/30; B30B 15/32
[52] U.S. Cl. ..... 100/207
[58] Field of Search ..... 100/207-209; 214/1 BB

[56] References Cited

U.S. PATENT DOCUMENTS

| | | | |
|---|---|---|---|
| 3,233,751 | 2/1966 | Bannon | 214/1 |
| 3,342,125 | 9/1967 | Curran | 100/207 |
| 3,707,908 | 1/1973 | Merk et al. | 100/207 |

*Primary Examiner*—Leonard D. Christian
*Attorney, Agent, or Firm*—Craig & Antonelli

[57] ABSTRACT

A workpiece turning device is provided for an automated press train of the type where workpieces are turned after being withdrawn from a working chamber of a press and are then subsequently fed to a further press. The turning device includes separately movable gripper arms for clamping a workpiece therebetween, as well as a rotary unit for rotating the gripper arms as a unit about an axis parallel to the plane of clamping movement. In preferred embodiments the gripper arms are actuated by piston-cylinder units connected to a pressure source by a rotatable connection.

16 Claims, 4 Drawing Figures

WORKPIECE TURNING DEVICE

BACKGROUND AND SUMMARY OF THE INVENTION

This invention relates to a turning device for an automated press line of the type where workpieces are turned after being withdrawn from a working chamber of a press and are then subsequently fed to a further press.

A turning device is known from DOS (German Unexamined laid-open-application) No. 1,552,592 and the corresponding U.S. Pat. No. 3,342,125 which is arranged between presses of an automated press line. In this system, workpieces are removed by means of unloading devices from the working chamber of a press and are transferred to a belt-type conveyor. The belt-type conveyor bridges the interspace between two presses and constitutes a transportation plane. Turning devices are arranged in mutual symmetry on both sides of the transportation plane formed by the belt-type conveyor. In this connection, the turning devices are fashioned as four-armed stars, recesses being provided in the end zone of each arm; the contours of these recesses being adapted to the workpieces to be turned. During operation, the workpieces to be turned are conveyed by the belt-type conveyor into the recesses of the turning elements, turned by 180 angular degrees by a rotation of the turning elements, deposited on the belt-type conveyor, transported, and fed to the working chamber of the subsequent press by means of loading devices. This conventional turning device requires a belt-type conveyor and turning elements fashioned in correspondence with the workpieces to be produced. Consequently, when the workpiece is altered, the turning elements must be exchanged.

This invention contemplates providing a turning device which is simpler in its structure than the above-mentioned apparatus and which can be used almost universally.

Preferred embodiments of this invention provide a turning device with (i) reversing gripper means having two separate gripper arms and clamp means movable with said gripper arms for selectively clamping a workpiece therebetween; (ii) a separately controllable gripper arm operating means for controlling the movement of each of the gripper arms, and (iii) rotating unit means for rotatably moving the gripper means, inclusive of the gripper arms and associated operating means. Preferably, each gripper arm is pivotably movable about the rotation axis of the rotary unit means by at least 90°, independantly of the other gripper arm, in order to accommodate transfer and turning of the workpiece. In the preferred embodiment described more fully hereinafter, the gripper arms are actuated by fluid operated piston means which are connected to respective fluid force supplies by way of a rotatable connection. To accommodate adjustment of the position of the gripper arms and the rotatable unit, preferred embodiments include adjustable connections therebetween as described more fully below.

The advantages inherent in a turning device according to this invention are to be seen particularly in the avoidance of belt-type conveyors, roller conveyors, or the like between the presses of an automated press line. Thereby, the distance of the presses of the automated press line with respect to one another can be reduced, resulting in a space-saving arrangement. The turning devices can be adapted to almost any workpiece to be turned, without having to effect an exchange. Furthermore, it is possible by means of a turning device in accordance with this invention to pivot the workpieces to be turned into any desired position.

Reference may be made to certain prior art devices which disclose particular features of the various structures which are to be combined in practicing this invention. For example, DOS No. 2,202,005 describes a transfer device for the transportation of workpieces wherein grippers are mounted on both sides of a transporting plane in mutual symmetry and with similar functions. Furthermore, a gripper is known from U.S. Pat. No. 3,400,836 wherein the two gripper arms can be opened up by means of an actuating element simultaneously by at least ± 90 angular degrees. U.S. Pat. No. 3,371,953 shows a gripper with two jaws mounted on a common fulcrum. A turning gripper per se is known from German Pat. No. 1,922,714 (especially FIG. 20). Finally, attention is directed to U.S. Pat. No. 2,757,037 wherein a gripper is disclosed, the jaws of which are movable by means of respectively one double-acting cylinder-piston unit. However, these prior-art arrangements do not contain any suggestion with respect to the solution according to the present invention.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
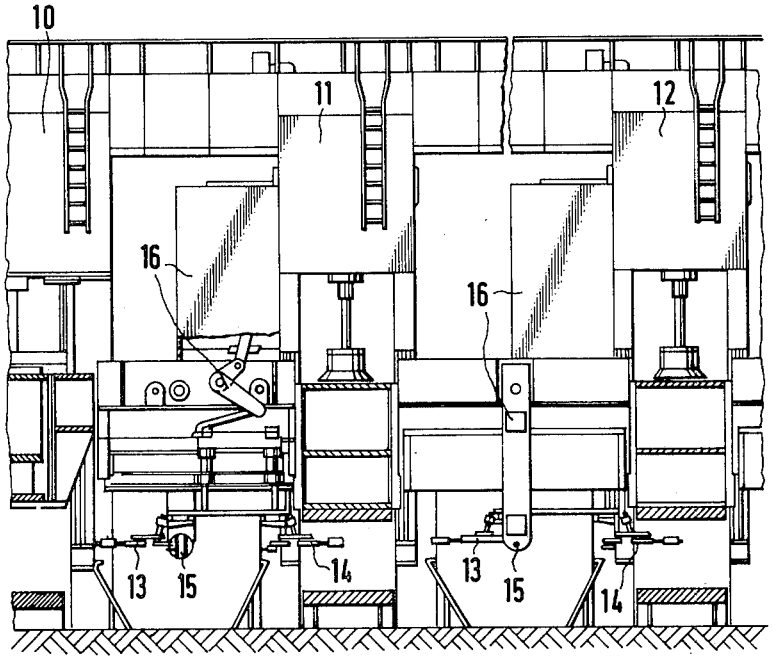
FIG. 1 is a schematic lateral part sectional view which shows part of an automated press train with a turning device constructed in accordance with the present invention.

FIG. 1 shows part of a first press 10, as well as two subsequent presses 11, 12; unloading (extractor) devices 13, loading devices 14, and turning devices 15 being arranged between the presses. The illustrated presses 10, 11, 12 are mechanical presses of a conventional type of structure and are disclosed, for example, in "SCHULER-Handbuch" (SCHULER Manual) 4th Ed., 1964, so that a more detailed description appears unnecessary for an understanding of the present invention. The unloading device 13, as well as the loading devices 14 are illustrated and described, in principle, in DOS No. 1,463,080, (U.S. Pat. Nos. 3,199, 439 and '443), for example, in FIG. 18 in particular. The unloading devices 13, loading devices 14, and turning devices 15 arranged between the presses 10, 11 and the presses 11, 12 are driven by way of conventional lever drive mechanisms 16 (DOS No. 2,308,539; DOS No. 2,334,722) (U.S. Pat. No. 3,941,240), each of these drive mechanisms being in operative connection with a press drive means, not illustrated in detail. By means of this drive connection, a mechanically positive actuation of the unloading devices 13, the loading devices 14, and the turning devices 15 in synchronism with the operating cycle of the presses 10, 11, 12 is ensured.

Figure 2:
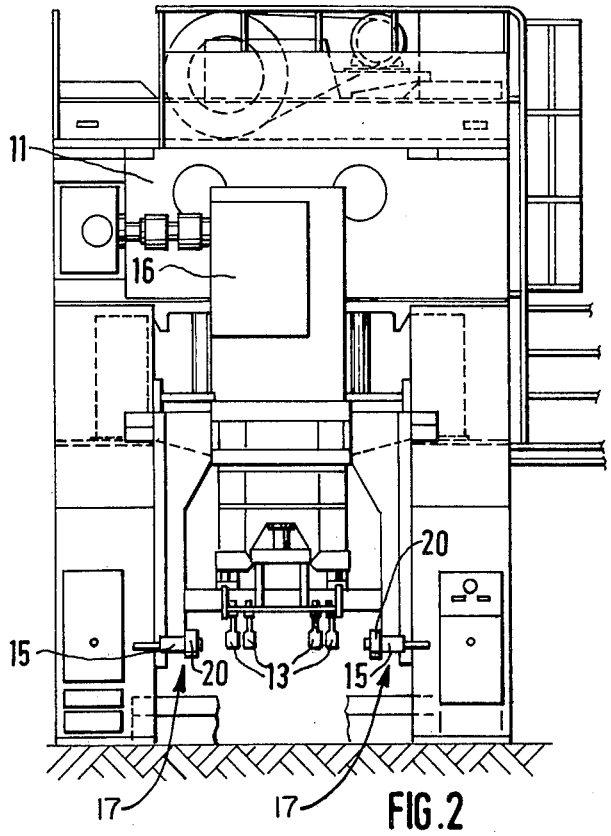
FIG. 2 is a schematic part sectional front view of one of the presses of FIG. 1 with the turning device.

FIG. 2 shows a front view of one of the presses 11, 12 wherein especially the spatial arrangement of the associated unloading devices 13 and the turning devices 15 are shown with respect to a transportation plane. The turning device 15 comprises two turning elements 17 only superficially indicated in FIG. 2; these turning elements being described in greater detail in FIGS. 3 and 4, using one of the turning elements 17 as an example.

The turning element 17 has a rotary unit 20 which is connected, vai connecting elements 21, with a lever drive mechanism 16. Separately controllable operating members 22, 23 are adjustably disposed at the rotary unit 20. The operating members 22, 23 are fashioned as single-acting cylinder-piston units operable against the force of a spring, wherein each cylinder-piston unit has respectively one piston rod 26, 27 guided in guide means 24, 25. The piston rods 26, 27 are joined to respectively one fishplate 28, 29 which are, in turn, articulated to respectively one gripper arm 30, 31. The gripper arms 30, 31 are supported on a central fulcrum 32 disposed in the forward region of a guide or protective plate 33. The protective plate 33 consists of two parts arranged in parallel and symmetrically to each other, between which are disposed the piston rods 26, 27 guided in the guide means 24, 25, the fishplates 28, 29 and part of the gripper arms 30, 31. The ends of the gripper arms 30, 31 facing away from the operating members 22, 23 are provided with clamping jaws 34, 35, whereby a reversing gripper is formed.

As described above, the operating members 22, 23 are adjustably mounted to the rotary unit; in detail, the cylinder-piston units are attached to a reversing gripper support 36 which latter is arranged so that it is rotatably clamped by means of a clamping ring 37 in the peripheral direction of this ring and so that it can be fixed in position at a square flange 38. The square flange 38 is mounted on a supporting plate 40 so that it is displaceable radially to the axis of rotation of the turning element 17 by means of clamping strips 39 and so that it can be fixed in position; the supporting plate 40, in turn, is connected via slotted ring segment guides 41 to a carrier plate 42 so that it is rotatable about the axis of rotation and so that it can be fixed in position. A quill shaft 43 is attached to the carrier plate 42, the connecting elements 21 engaging the periphery of this shaft. The connecting elements consist essentially of a pinion quill shaft 44 wherein the quill shaft 43 is disposed to be rotatable in the direction of the axis of rotation (horizontal axis as viewed in FIG. 3) and to be fixable in position. Within and coaxially to the quill shaft 43, a tube 45 is arranged. The ends of the quill shaft 43 and of the tube 45 facing away from the carrier plate 42 are rotatably connected to a double air connection 46, whereas the end of the tube 45 facing the carrier plate 42 is sealingly mounted with respect to a remaining hollow space 47 of the quill shaft 43. The construction and arrangement of the quill shaft 43 and of the tube 45 serve advantageously for the supply of air to the operating members 22, 23, since thereby long hose connections at the rotating turning elements 17 are avoided. The air supply to the operating member 22 is effected from the double air connection 46 by way of the tube 45 and a short conduit 48, whereas the operating member 23 is supplied by the double air connection 46 by way of the hollow space 47 of the quill shaft 43 and a further short conduit 49.

The function of the turning device 15 will be described in greater detail below in conjunction with the presses 10, 11, 12, the unloading devices 13, and the loading devices 14 illustrated in FIGS. 1 and 2.

By means of the unloading devices 13, a workpiece is withdrawn from the working chamber of the first press 10 after a non-cutting shaping operation and optionally with an interposed storage step, and transferred to the turning device 15 whereafter it is turned by 180 angular degrees and passed on in this position to the loading devices 14. The loading devices 14 then convey the workpiece, optionally again with the interposition of a storage step, into the working chamber of the subsequent press 11 wherein another shaping operation is conducted. From the press 11, the workpiece is passed on in the same way to the press 12.

Figure 3:
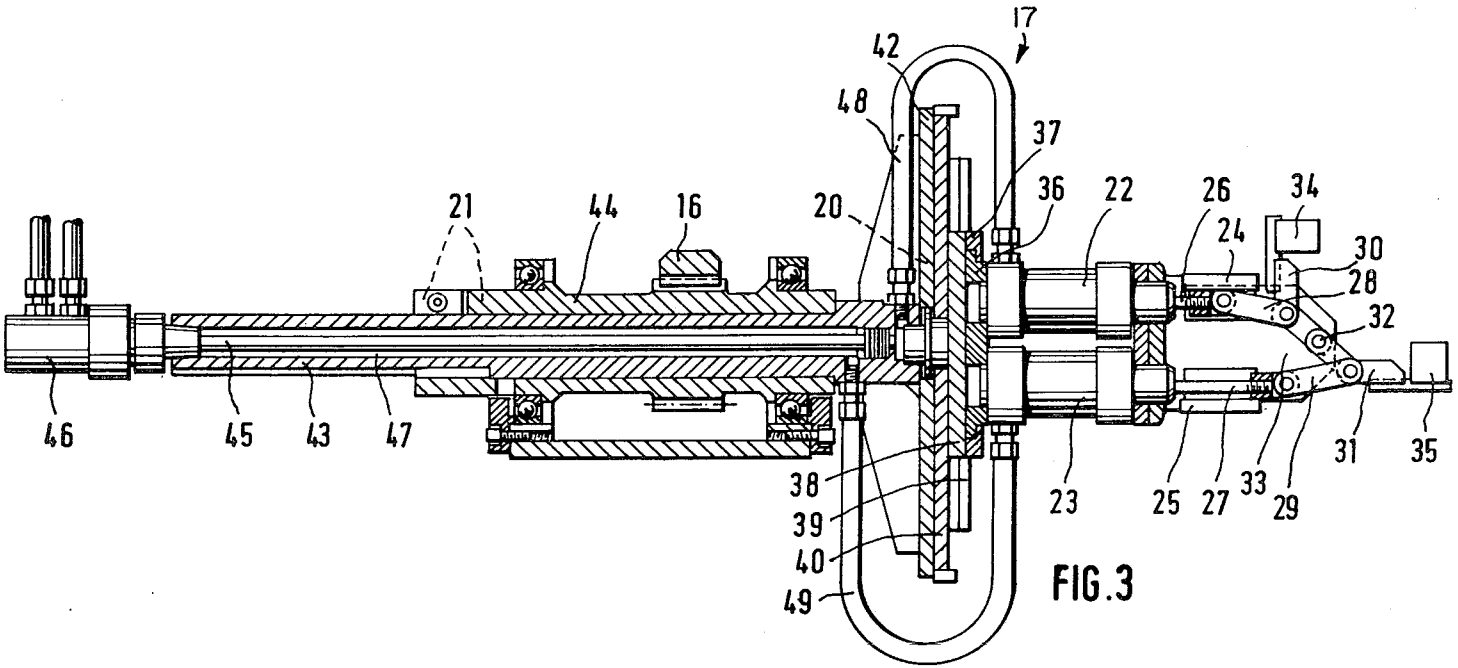
FIG. 3 shows the turning device of the present invention partially in section.
Figure 4:
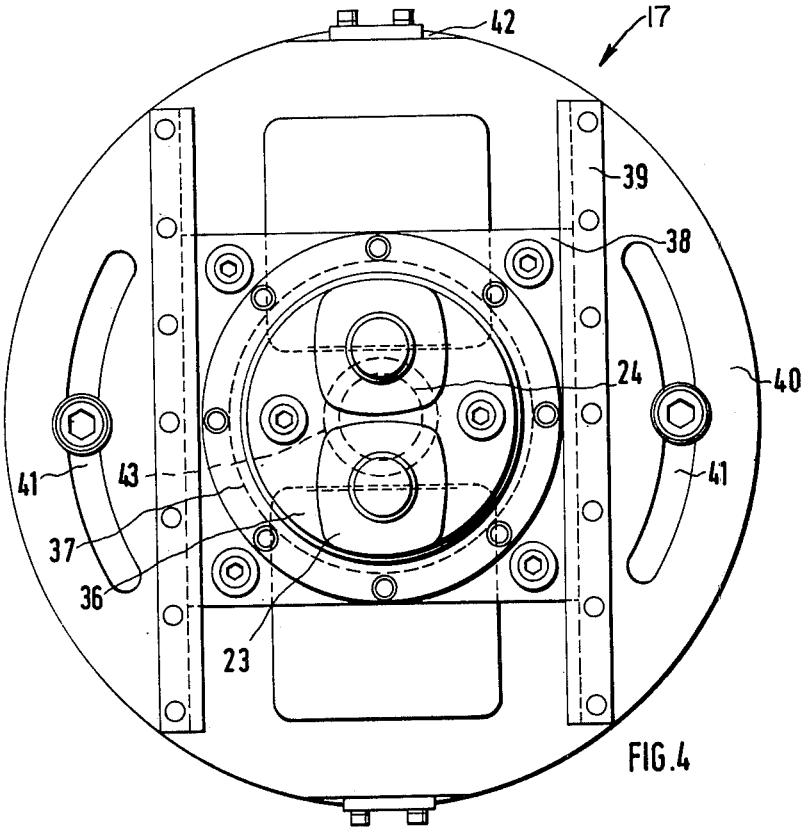
FIG. 4 shows a rotary arrangement of the turning device of the present invention in a plan view.

During the transfer of the workpiece from the unloading device 13 to the turning device 15, the turning elements 17 assume the position illustrated in FIG. 3. The lower operating member 23 is exposed to compressed air, and the gripper arm 31 assumes its closed position and constitutes together with the clamping jaw 35 a depository. The upper operating member 22 is not acted upon, and the gripper arm 30 is pivoted open with respect to the axis of rotation by 90 angular degrees. As soon as the workpiece has been deposited on the clamping jaw 35, the operating member 22 is exposed to compressed air via conduit 48, so that the gripper arm 30 is moved into its closed position. In the closed position, the workpiece is held between the two clamping jaws 34, 35. By means of the lever drive mechanism 16, engaging the pinion quill shaft 44, the turning element 17 is rotated about the axis of rotation by 180 angular degrees. Thereafter, the operating member 23, which is then disposed on top, is vented, and the gripper arm 31 is pivoted open by 90 angular degrees, whereas the gripper arm 30, which is presently at the bottom, remains in its closed position. The workpiece is now seized by the loading devices 14 and conveyed further. A new operating cycle along the above-described lines can now be executed.

During the rotation of the turning element 17, the double air connection 46, due to the rotatable coupling with the quill shaft 43 and the tube 45, remains almost in its stationary position, so that the air supply lines are not pivoted concomitantly.

Due to the construction of the rotary unit 20 (FIG. 4) and the adjustability in the direction of the axis of rotation, the turning elements 17 can be adjusted to any desired positions and turning angles. The axis of symmetry of the gripper arms 30, 31 is adjustable radially to the axis of rotation by means of the clamping strips 39 and the square flange 38. The reversing gripper support 36 and the clamping ring 37 provide a rotation with respect to the axis of symmetry proper of the gripper arms 30, 31. A rotation with respect to the axis of rotation, in turn, is obtained by rotating the supporting plate 40 in correspondence with the slotted ring segment guides 41 with respect to the carrier plate 42. The adjustability of the turning element 17 in the direction of the axis of rotation is attained by a releasable, positive connection between the quill shaft 43 and the pinion quill shaft 44. The turning device described herein can be rotated in the clockwise direction as well as in the counterclockwise direction.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Workpiece turning device for an automated press line of the type where workpieces are turned after being withdrawn from a working chamber of a press and are then subsequently fed to a further press, said turning device comprising:

reversing gripper means having two separate gripper arms and clamp means movable with said gripper arms for selectively clamping a workpiece therebetween;

a separately controllable gripper arm operating means for controlling the movement of each of said gripper arms;

and rotary unit means for rotatably moving said gripper means, inclusive of said two gripper arms and associated gripper operating means.

2. Turning device according to claim 1, wherein said gripper arm operating means includes means for moving said gripper arms in a plane containing the axis of rotation of said rotary unit means.

3. Turning device according to claim 1, wherein each gripper arm is pivotably movable by at least 90 angular degrees independently of the other gripper arm.

4. Turning device according to claim 2, wherein said rotary unit means in cludes means for rotating said gripper means in dependence on the operating cycle of the press line.

5. Turning device according to claim 3, wherein said gripper arm operating means includes means for moving said gripper arms in a plane containing the axis of rotation of said rotary unit means.

6. Turning device according to claim 1, wherein said reversing gripper means has a central fulcrum upon which the two gripper arms are supported.

7. Turning device according to claim 5, wherein said reversing gripper means has a central fulcrum upon which the two gripper arms are supported.

8. Turning device according to claim 2, wherein the rotary unit means comprises a carrier plate arranged symmetrically to the axis of rotation of the rotary unit means, a supporting plate with slotted ring segment guides, said supporting plate being mounted to be rotatable about the axis of rotation and to be fixable in position by way of said slotted ring segment guides, a square flange and clamping strips, said square flange being mounted to the supporting plate by means of said clamping strips to be displaceable radially to the axis of rotation and to be fixably in position, a reversing gripper support and a clamping ring, said reversing gripper support being arranged at the square flange to be rotatable by means of said clamping ring in the peripheral direction of the latter and to be fixable in position, and the gripper arm operating means including the reversing gripper being attached to the reversing gripper support.

9. Turning device according to claim 5, wherein the rotary unit means comprises a carrier plate arranged symmetrically to the axis of rotation of the rotary unit means, a supporting plate with slotted ring segment guides, said supporting plate being mounted to be rotatable about the axis of rotation and to be fixable in position by way of said slotted ring segment guides, a square flange and clamping strips, said square flange being mounted to the supporting plate by means of said clamping strips to be displaceable radially to the axis of rotation and to be fixably in position, a reversing gripper support and a clamping ring, said reversing gripper support being arranged at the square flange to be rotatable by means of said clamping ring in the peripheral direction of the latter and to be fixable in position, and the gripper arm operating means including the reversing gripper being attached to the reversing gripper support.

10. Turning device according to claim 1, wherein the gripper arm operating means include single-acting cylinder-piston units.

11. Turning device according to claim 5, wherein the gripper arm operating means include single-acting cylinder-piston units.

12. Turning device according to claim 8, wherein the gripper arm operating means include single-acting cylinder-piston units.

13. Turning device according to claim 12, wherein the cylinder-piston units are eccentrically attached to the reversing gripper support with operating directions which are in parallel to the axis of rotation and comprise respectively one piston rod which engages respectively one fishplate articulated to the gripper arms.

14. Turning device according to claim 1, wherein a pair of said reversing gripper means are provided for each press subsequent to the first press in the press line.

15. Turning device according to claim 13, wherein a pair of said reversing gripper means are provided for each press subsequent to the first press in the press line.

16. Turning device according to claim 14, wherein said workpieces are transferred between loading and unloading devices and, said presses exclusively by means of said turning device and associated gripper means.

* * * * *